US006933826B2

(12) United States Patent
Gijs

(10) Patent No.: US 6,933,826 B2
(45) Date of Patent: Aug. 23, 2005

(54) METHOD OF MANUFACTURING DISCRETE ELECTRONIC COMPONENTS

(75) Inventor: Martin Gijs, Etoy (CH)

(73) Assignee: Ecole Polytechnique Federale de Lausanne, Lausanne (CH)

( * ) Notice: Subject to any disclaimer, the term of this patent is extended or adjusted under 35 U.S.C. 154(b) by 115 days.

(21) Appl. No.: 10/697,439

(22) Filed: Oct. 31, 2003

(65) Prior Publication Data

US 2004/0088841 A1 May 13, 2004

Related U.S. Application Data

(62) Division of application No. 09/889,739, filed on Jul. 20, 2001, now Pat. No. 6,704,994.

(30) Foreign Application Priority Data

Jan. 22, 1999 (EP) ..... 99101187

(51) Int. Cl.[7] ..... H01F 5/00
(52) U.S. Cl. ..... 336/200; 336/223; 336/232
(58) Field of Search ..... 336/200, 223, 336/232; 29/602.1, 605, 606

(56) References Cited

U.S. PATENT DOCUMENTS 4,342,142 A 8/1982 Jenning et al.
5,010,314 A 4/1991 Estrov
5,321,380 A * 6/1994 Godek et al. ..... 336/232
5,463,365 A 10/1995 Iwatani et al.
5,852,886 A 12/1998 Kuettner et al.
5,952,909 A 9/1999 Umeno et al.
6,433,665 B2 8/2002 Huang et al.
6,664,883 B2 * 12/2003 Patel et al. ..... 336/200

* cited by examiner

*Primary Examiner*—Anh Mai
(74) *Attorney, Agent, or Firm*—Sughrue Mion, PLLC

(57) ABSTRACT

The manufacturing method for components of the inductive type, in particular inductance coils, transformers or antennae, consists in making by micro-machining simultaneously on a first substrate made of magnetic material a plurality of first parts (1) connected to each other by connecting elements (2) or a connecting support, inserting on the arms (8*a*, 8*b*, 8*c*) of these first parts (1) a printed multi-layered plate (4, 5) having openings for the arms and metal windings ending in at least two contact pads (7*a*, 7*b*), in placing and securing a second substrate made of magnetic material on the first substrate and the plate, said second substrate having undergone micro-machining to obtain second parts (13) complementary to the first parts. These second parts are connected to each other by connecting elements or a connecting support. Then, the components are separated and, in a particular implementation, the contact pads arranged on tongues (16, 18) of said plate are folded against a base (9) of the core or of the magnetic circuit to form a surface mounting device.

3 Claims, 6 Drawing Sheets

METHOD OF MANUFACTURING DISCRETE ELECTRONIC COMPONENTS

This is a divisional of application Ser. No. 09/889,739 filed Jul. 20, 2001 now U.S. Pat. No. 6,704,994; the disclosure of which is incorporated herein by reference.

BACKGROUND OF THE INVENTION

The present invention concerns a discrete electronic component of the inductive type and a method for manufacturing such components. In particular, these components are used in surface mounting techniques (SMD), particularly inductance coils or transformers.

Manufacturing electronic components for surface mounting is well known, particularly for making resistors or capacitors, but this poses problems for the series manufacture of inductance coils or transformers of millimetric dimensions, because they are currently made separately from each other.

In many electronic applications, electronic components of the inductive type are needed as an interface, for example, between voltage levels provided by a power source and integrated circuit input voltages. These inductive elements are used in particular to even ripples on signals. Often the inductance values need to be high, of the order of mH. Usually, the manufacture of such inductive elements does not pose any problem if ferrite cores are used with electric windings of dimensions of the order of one centimeter. However, when the size of the components has to be reduced, there are serious constraints on the technology to be used to make them with high inductance values.

Likewise, for the manufacture of antennae of small dimensions formed of a winding and a magnetic core, the market needs a technology which allows inexpensive manufacturing of large quantities.

SMD type coils proposed by Coilcraft in Cary, Ill., United States are known, i.e. coils able to be mounted on metal pads made on hybrid structures particularly made of ceramic material. These coils are formed of a magnetic core on which a metal wire is wound around the central part and the ends of which are each connected on a metal pad of end parts on either side of the central part. The metal pads may act as a contact with the corresponding metal pads made on a hybrid structure including connection paths with different electronic components. The value of these coils is at the most 10 $\mu$H for dimensions of 3 mm×3 mm×2.5 mm. It is clear that they are made one after the other because it is necessary to wind the wire around each magnetic circuit independently, which requires manufacturing time and a high cost.

U.S. Pat. No. 5,463,365 discloses a coil which includes a magnetic core and a winding part formed of a plurality of laminated sheets including windings arranged in a spiral around the core so as to be coaxial. The connection between the windings located on superposed sheets occurs via metallised holes which are well known to those skilled in the art. This method allows a certain number of sheets or layers to be stacked, particularly sheets made of polyimide resin, depending on the number of turns of metal wires desired for the design of the coil.

The manufacture of the coils specified in this American patent is complicated since, to obtain a component of the SMD type able to be mounted on a hybrid structure, in addition to the arrangement of a magnetic core with its winding stack, the embodiments given have an entire infrastructure with a cover for the two sides of the magnetic circuit and several output terminals not all of which are used if the components only has one winding. The shape of said component may be similar to that of a component with a plastic encapsulation case, which is not suitable for very small dimensions. Moreover, the assembly of this component is effected individually.

U.S. Pat. No. 5,760,671 discloses a transformer having two magnetic flux paths defined by a ferrite magnetic circuit in the shape of an eight, this transformer including a plate formed of stacked layers with printed circuits defining the primary and secondary windings of the transformer. The plate has an opening for the central arm of the magnetic circuit which is surrounded by the windings. These windings are raised from the base of the magnetic circuit by steps arranged in corners of the two openings defined by the magnetic circuit.

This transformer is used for voltages of up to 400 V for dimensions exceeding one centimeter. For these dimensions, the manufacture of such components does not pose any particular problem but it cannot be used as a component of the SMD type. Assembly of the plate with the magnetic circuit in two parts is effected individually, as is the bonding of the two parts of the magnetic circuit.

SUMMARY OF THE INVENTION

The invention proposes to overcome the drawbacks of the prior art as regards the manufacture of inductive components in particular components of millimetric dimensions.

The invention proposes particularly to provide a method for batch processing a plurality of inductance coils or transformers so as to avoid difficult individual mounting of the different parts forming each coil or each transformer of millimetric dimensions.

Each identical or equivalent part of a batch of inductive components is thus manufactured in or on the same substrate so as to have a plurality of identical parts connected to each other by connecting elements which are machined into the substrate or by a support secured to the substrate, prior to being separated once the assembly of the different parts is finished. Via this method, manufacturing time is saved, and the handling of the different parts is greatly facilitated which reduces the cost price.

Within the scope of the embodiment of the present invention, it has been observed that it is possible to obtain high inductance values, of the order of one mH, for millimetric dimensions, while reducing the current passing through the winding.

The method for manufacturing electronic components of the inductive type forming the subject of the invention, and components able to be obtained by this manufacturing method, also forming the subject of the invention, are defined precisely in the annexed claims.

BRIEF DESCRIPTION OF THE DRAWING

Other particular advantages and features of the present invention will be described with reference to the following description and the annexed drawings, given by way of non limiting examples, in which.

The manufacture of inductance coils, transformers or antennae of millimetric dimensions poses certain problems during handling of the elements to be assembled, in particular ferrite cores or magnetic circuits. In order to overcome these difficulties, the method according to the invention proposes batch processing these inductive components, by providing three main steps for assembling the magnetic circuit parts with their metal windings. An implementation of this method will be described hereinbelow with reference to FIGS. 1 to 3.

Figure 1:
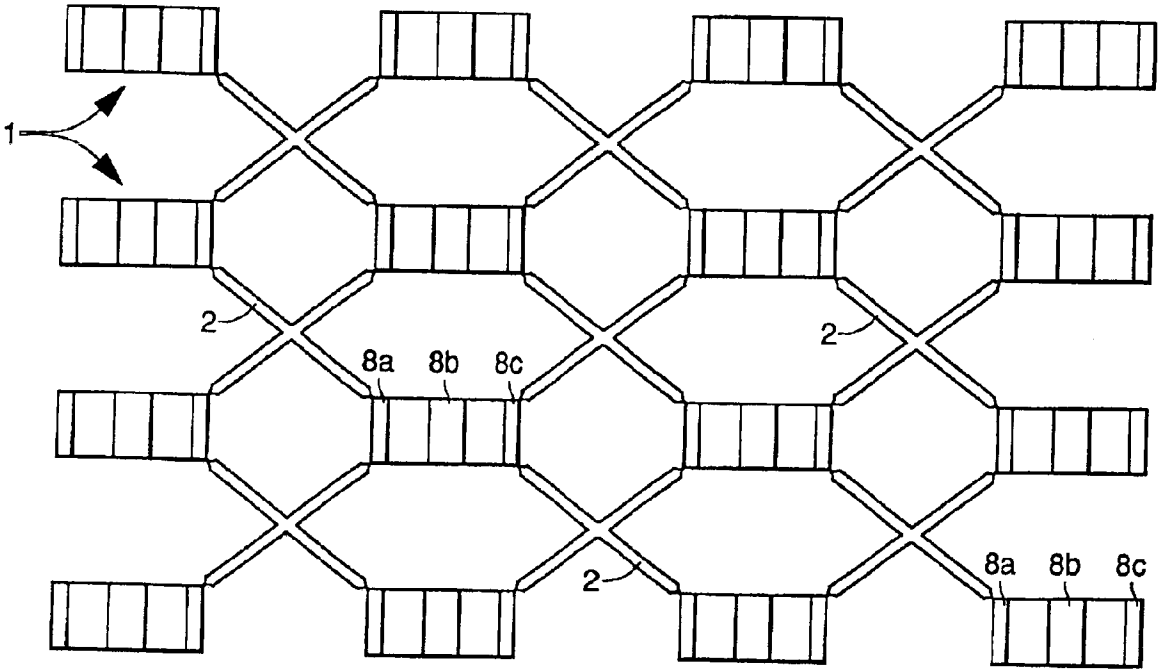
FIG. 1 shows one of the substrates having undergone micro-machining according to method of the invention with identical magnetic circuit parts connected to each other.

First of all, a first step consists in micro-machining on a flat substrate, 1 mm thick and with a surface of 10×10 $cm^2$ for example, made of a magnetic material such as ferrite, to obtain a plurality of first magnetic circuit parts 1 which are identical and connected to each other by connecting elements 2 (see FIG. 1). Each first magnetic circuit part is formed of a base 9 and three arms 8*a*, 8*b* and 8*c* projecting from said base. The width of central arm 8*b* is double that of each of arms 8*a* and 8*c* located at the ends of base 9. This first substrate has been placed and held on a working support, in particular of the type of those used for sawing integrated circuit plates. All the first parts are thus held with a constant spacing because they are connected by connecting elements 2 which are made of the same material as the first magnetic circuit parts in the variant of FIG. 1. In another variant, the first parts are secured to a working support which has the function of materially connecting the first parts during batch processing of the inductive components so as to keep them in predetermined respective positions.

A thousand magnetic circuits may be processed simultaneously according to the method of the invention for a same initial magnetic substrate.

Figure 3:
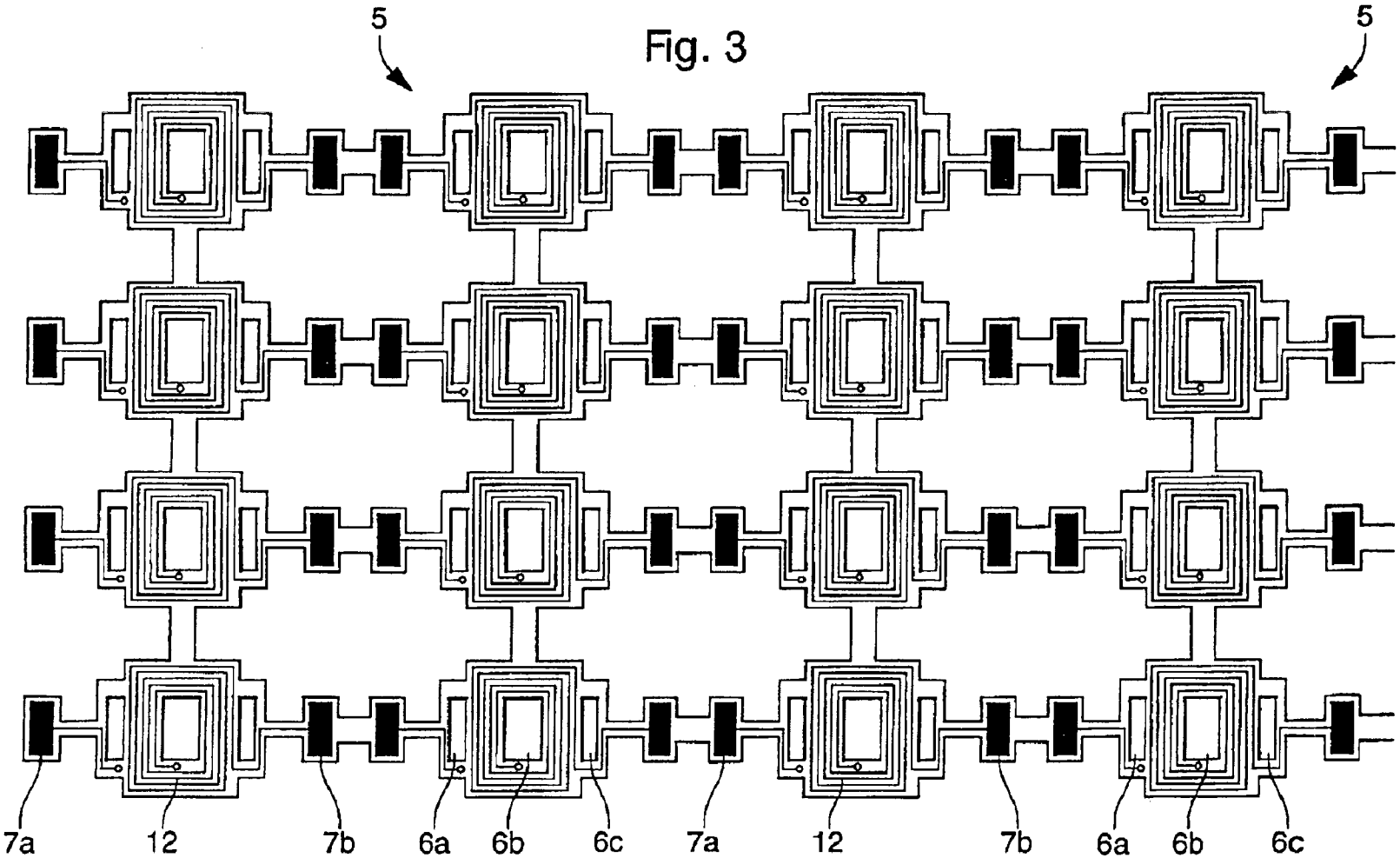
FIG. 3 shows a multi-layered plate of printed circuits with several metal windings.

Once the first step is finished, a printed plate 5, which can be seen in FIG. 3, is added, arranged so that arms 8*a*, 8*b* and 8*c* are inserted into openings 6*a*, 6*b* and 6*c* made in this plate in a number corresponding to the number of arms of the first substrate machined with identical spacing. Plate 5 includes a plurality of windings 12 each formed of at least a metal path wound in the shape of a spiral on a layer or sheet of said plate. A winding 12 may include a set of metal paths deposited on a set of layers forming a multi-layered plate, these paths being connected from one layer to the next via the technique of conductive or via holes 11 (with example with copper) which is well known to those skilled in the art. Each winding 12 ends in two electric contact pads 7*a* and 7*a*, outside the projection of the magnetic circuit in the general plane of the plate, intended to be used, once the component is made, for connecting the latter to corresponding pads of a hybrid structure, in accordance with the mounting technique of SMD type components. The set of electric contact pads is preferably located on a same layer of the plate by using, if necessary, said conductive or via hole technique.

Printed plate 5 is formed of layers or sheets of polyimide resin. Punched parts may be provided around the windings in order to facilitate separation of the finished components, as shown in FIG. 3. It will be noted that two coaxial windings can be provided on a same layer. Moreover, it is possible to provide metal paths on two sides of a same layer. In this latter case, care must be taken to assure the necessary electric insulation if there are several printed layers.

Figure 5:
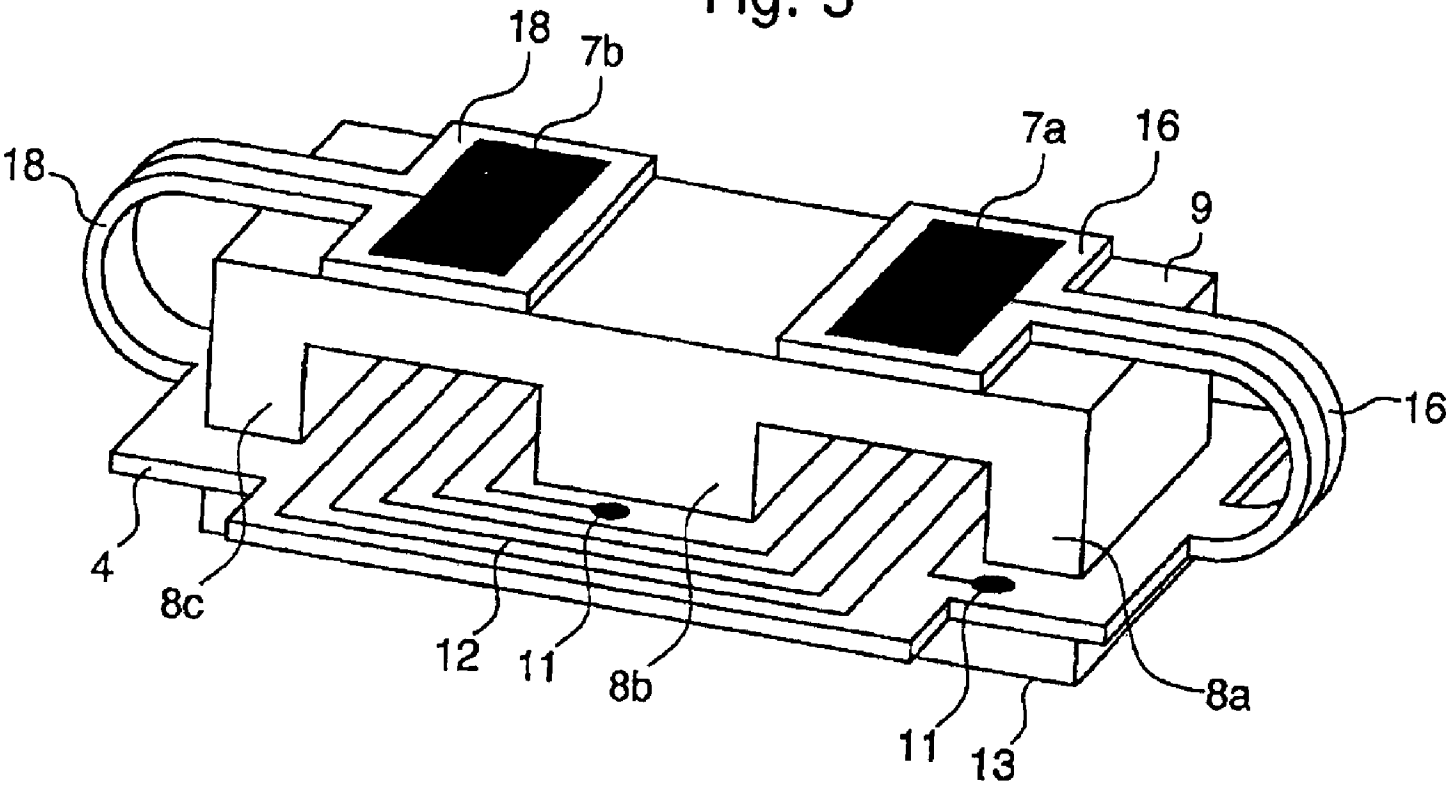
FIG. 5 shows an inductance coil obtained according to the method of the invention.

In the case of an inductance coil as shown in FIG. 5, first part 1 is associated with a single winding with two metal paths arranged respectively on both sides of plate 4, this winding ending in two contact pads 7*a* and 7*b*.

In the case of a transformer, the magnetic circuit includes two windings each with at least two contact pads. The contact pads of these two windings are preferably located on a same external layer of plate 5. If the secondary winding of the transformer includes more than two contact pads, there may be a variable voltage ratio between the primary and secondary winding.

The third step of the method consists in fixing, in particular by bonding, a second substrate made of magnetic material, such as ferrite, on the first substrate. The second substrate is micro-machined so as to form a plurality of second magnetic circuit parts 13 connected to each other by connecting elements of the same material, in a similar way to that shown in FIG. 1. Each second part 13 closes each first magnetic circuit part 1 with the printed plate 5 inserted between base 9 of first part 1 and the corresponding second part 13 which also defines at least one base.

The shape of the two magnetic circuit parts may be similar to the shape of the first magnetic circuit parts, the free ends of the arms of the first and second parts then being located facing each other.

In another variant, the second parts are secured to a working support, in particular an adhesive sheet, which has the function of materially connecting the second parts during batch processing.

Second magnetic circuit parts 13 may consist only of a crosspiece forming a base simply placed on the arms of the first part and entirely covering them so that once the two parts are connected, the resulting magnetic circuit has the general shape of an eight. This configuration is used in the case that plate 5 includes for example two layers for a single winding 12 defining an inductance coil as shown in FIG. 5. If, however, the thickness of the multi-layered plate has to be greater than the height of the arms of the first magnetic circuit part, particularly in the case in which it includes four or more layers for a transformer, one will preferably use second parts equivalent to the first parts in order to be able to close the magnetic circuit.

Once these three important steps are completed, it is possible to separate the components by appropriate machining or cutting. It will be noted that the first and second magnetic parts may form a coil core, in particular of an antenna, which is not closed over itself, as in the embodiment of FIGS. 6 and 7 which is described hereinbelow.

Figure 4:
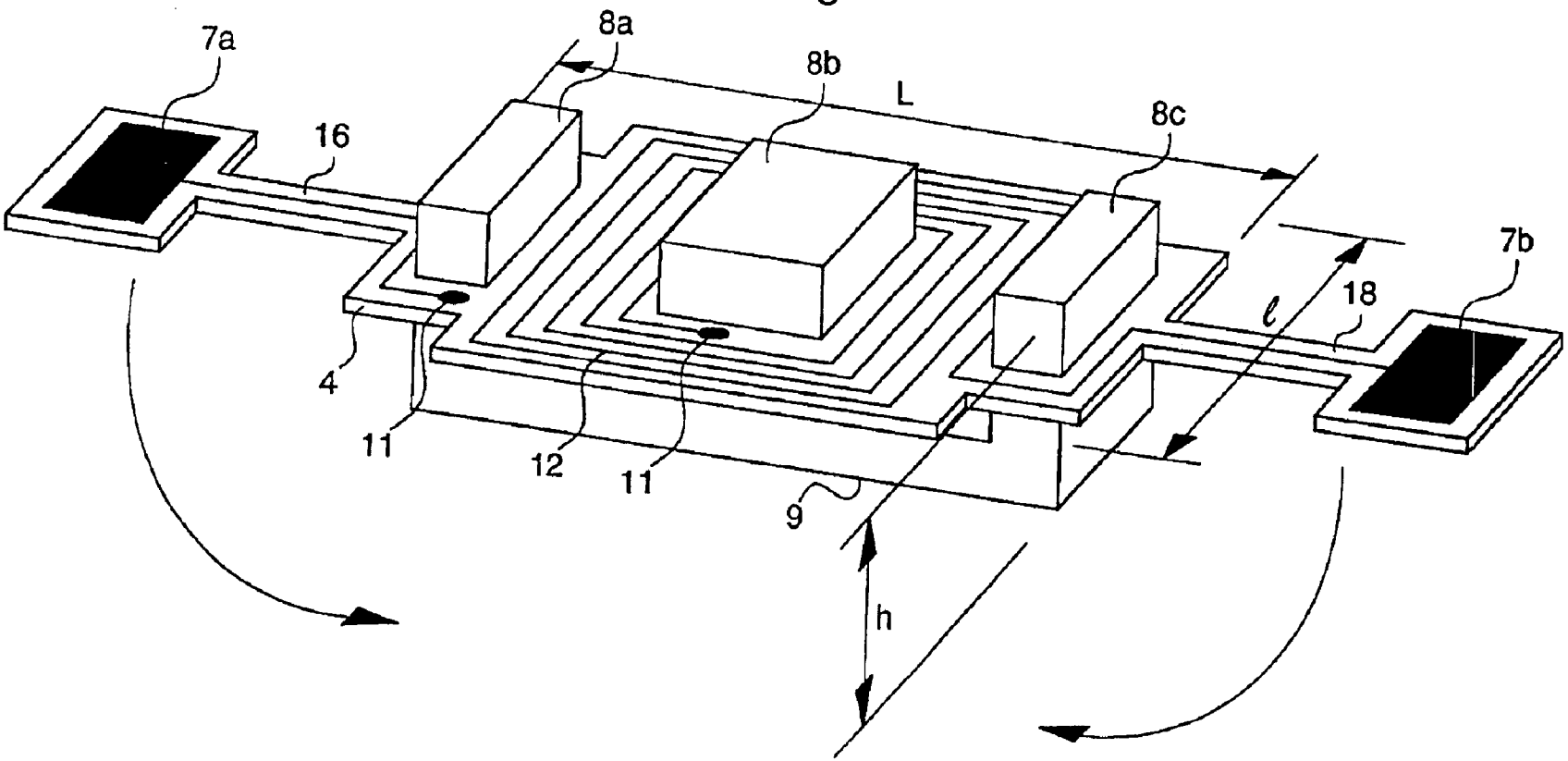
FIG. 4 shows a first magnetic circuit part with a metal winding on a printed circuit plate inserted between the arms of the magnetic circuit.

According to a preferred implementation of the method of the invention, the electric contact pads of a component are arranged on at least a tongue formed in plate 5 during the machining or cutting, if this has not already been done in a preliminary step or when multi-layered plate 5 is formed. Thus, a tongue may have one or more contact pads. Next, with reference to FIG. 4, tongues 16 and 18 having electric contact pads 7*a* and 7*b* are folded onto an external surface of the magnetic circuit, in particular on the back of base 9 of its first part 1, and they are bonded to this base. FIG. 4 shows via arrows the direction in which tongues 16 and 18 are folded, with, at their ends, said pads 7*a* and 7*b*. These pads are intended to be soldered in particular onto electric contact pads provided on a hybrid structure for connecting the inductance coil or transformer to other components of the hybrid structure.

It will be noted that in an advantageous variant tongues 16 and 18 can be folded with their respective pads prior to separation of the components, provided that plate 5 is punched or cut around tongues 16 and 18.

As can be seen in FIGS. 4 and 5, plate 4 cut from plate 5 has portions extending beyond the width of the magnetic circuit. These portions may also be folded in the direction of the base of the magnetic circuit and bonded with insulation against the arms and base of the circuit. This allows space to be saved.

During bonding of the second magnetic circuit part with the first part, it is possible for the adhesive to engulf at least part of multi-layered plate 4 so s to secure it fixedly to the magnetic circuit.

Figure 2:
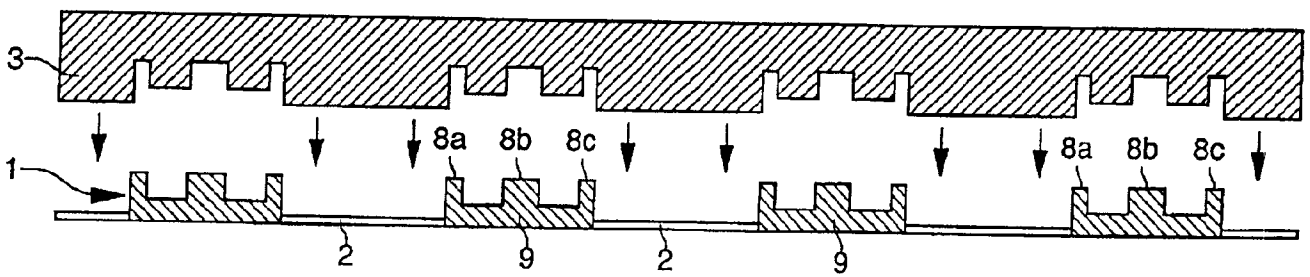
FIG. 2 shows machining via electro-erosion of a substrate according to one implementation of the method of the invention.

The micro-machining manufacturing the first and second magnetic circuit parts can preferably consist in electro-erosion machining as shown schematically in FIG. 2. An electrode 3 with relief patterns is used to make a plurality of identical magnetic parts defined by the electrode. The electrode could in certain cases include zones with different patterns to make magnetic circuit parts which are different from one zone to another on a same substrate.

The micro-machining manufacturing the first and second magnetic circuit parts may also use a sand blasting technique.

The micro-machining for manufacturing the first and second magnetic circuit parts and for separating the components may use a laser, in particular for the cutting steps.

The dimensions of the inductive type component may be in particular a width I of between 0.5 mm and 1 mm and a length L of between 1.4 mm and 2.8 mm for a height h of 1 mm to 1.5 mm. Each arm is raised for example by approximately 0.2 mm above base 9. The width of the central arm is double the width of the two arms located at the ends of the base and its value is for example approximately 0.4 mm. For these dimensions, a multi-layered plate of printed circuits including one or two windings, for example a winding with a number N or turns equal to 56 or 18. In the case that N=56, the inductance value is approximately 1 mH, while for N=18, the inductance value is approximately 0.1 mH.

The metal paths of plate 4 are obtained in particular using a plasma etching process with a depth of 10 to 15 $\mu$m. They are for example 50 $\mu$m wide. The pitch between two paths of a same winding is 14 $\mu$m for an inductance value of 1 mH and 44 $\mu$m for an inductance of 0.1 mH. The metallised holes are approximately 100 $\mu$m wide.

The manufacture of all these windings on multi-layered plate 5 is known to those skilled in the art.

Other shapes may be envisaged for the closed magnetic circuit. Instead of three arms, the magnetic circuit may include only two. In such conditions, the two bases must each have a thickness which is double that of the eight shape; which produces components of greater height. The method according to the invention may also be used to manufacture coils with a core. In this latter case, there is only a single arm per component.

Figure 6:
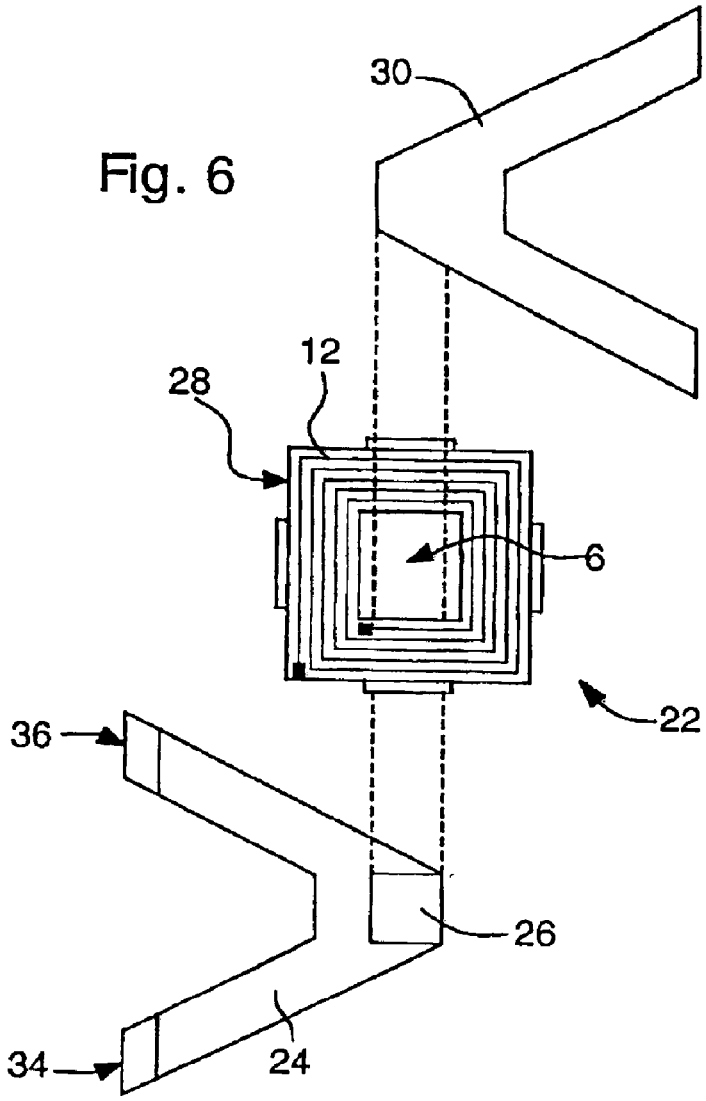
FIG. 6 is an exploded view and FIG. 7 is a top view of an antenna according to the invention.
Figure 7:
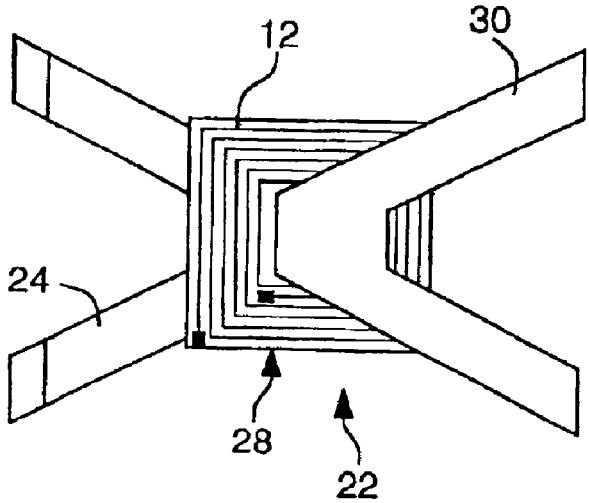
Figure 8:
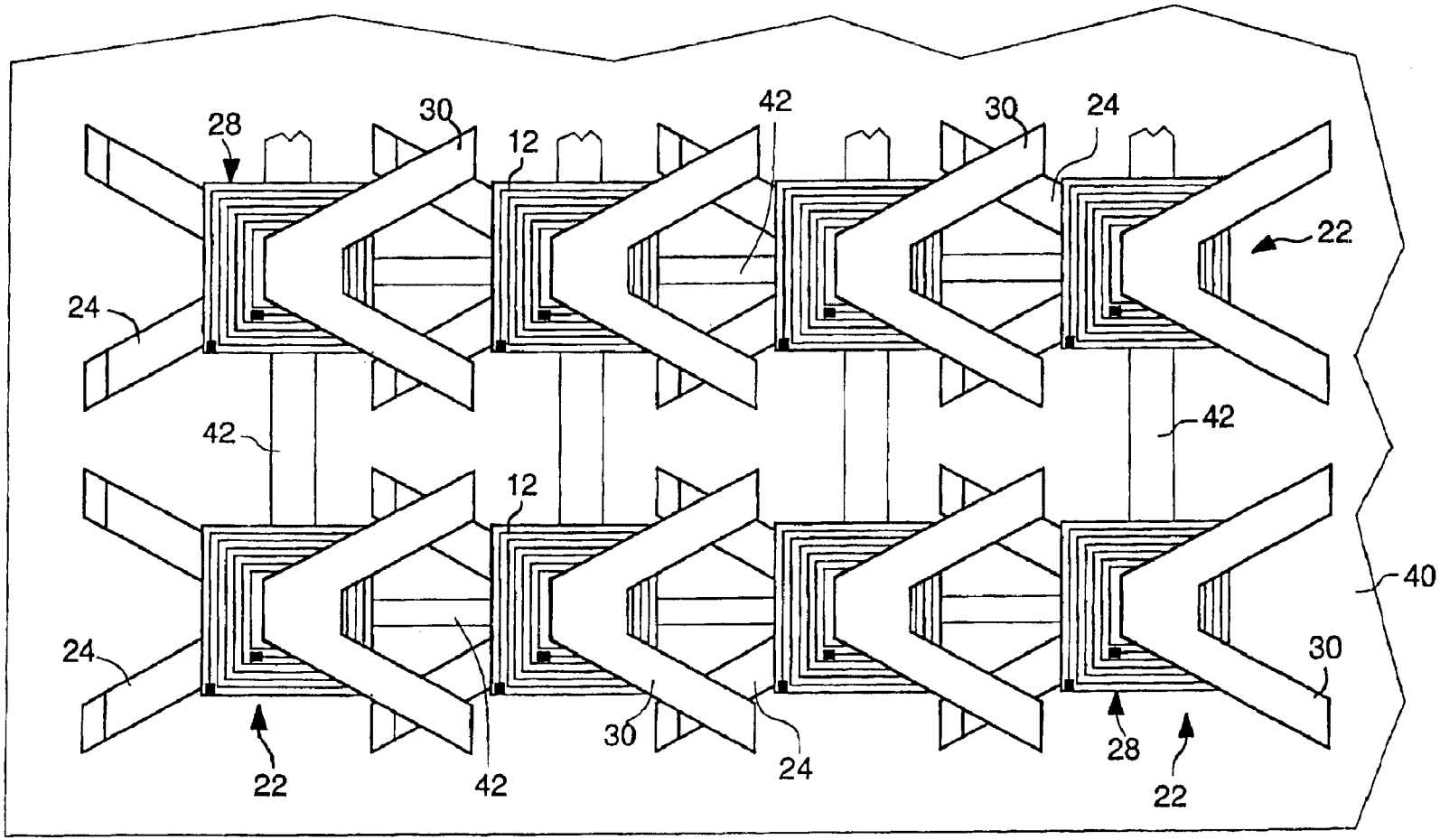
FIG. 8 is a top view of a set of antennae after batch assembly and prior to separation into distinct components.

With reference to FIGS. 6 to 8, an antenna formed according to the method of the invention will be described hereinbelow. This antenna 22 is essentially formed of three parts. It includes a first base 24 made of magnetic material and an arm 26 projecting from the base, a plate 28 on which there is provided an electric winding 12 of the type described previously, and a second base 30 made of magnetic material. "Magnetic material" means a ferromagnetic material having relatively high magnetic permeability.

Each of the two bases 24 and 30 has the general shape of a V extending respectively into two parallel planes substantially perpendicular to the direction of arm 26. Preferably, plate 28 is secured to the core such that its general plane is also substantially perpendicular to the direction of said arm. Plate 28 has an opening 6 into which arm 26 of base 24 is inserted. In the variant shown, the free ends of the two branches defining the V shape of each of the bases have projecting parts 34 and 36 in the direction of the general plane of plate 28. Bases 24 and 30 and arms 26 which connect them materially and magnetically together form an antenna core. Each of the bases has its two branches connected by a connecting portion where which arm 26 is located. In projection onto the general plane of the antenna, the antenna core has the general shape of an X assuring sensitivity for the antenna as a function of the direction in said general plane. It will be noted that base 30 may also have a similar arm to arm 26. However, a single arm integral with one or the other of the two bases is sufficient provided that its height is equal to or greater than the thickness of plate 28.

The arrangement of antenna 22 is particularly advantageous due to the fact that the two bases forming the antenna core and the plate acting as a support for a flat winding extend into parallel planes allowing easy assembly of the three parts concerned. Thus, the direction or the plane of maximum sensitivity of the antenna is parallel to the general plane defined by flat winding 12, unlike an antenna coiled on a bar shaped core whose direction of maximum sensitivity is perpendicular to the plane defined by the turns of the coil. In other words, the direction of maximum sensitivity or the plane of maximum sensitivity of an antenna formed of a coil and a magnetic core is generally parallel to the magnetic axis of the coil. Conversely, antenna 22 has maximum sensitivity along one or several directions substantially perpendicular to the magnetic axis of winding 12 forming an antenna coil.

It will be noted that the bases forming the antenna coil may have, in the general plane of the antenna defined by plate 28, varied and different contours. In particular, the bases may be formed of a simple bar of which at least one includes an arm 26 projecting along a substantially perpendicular direction. Preferably, the arm is located at two respective ends of the bases, which extend from these two ends along opposite general directions.

The arrangement of the various parts forming antenna 22 allows inexpensive batch processing according to the method of the present invention. FIG. 8 shows a batch of antennae after mounting and prior to separation of the antennae. Bases 24 are arranged on an adhesive support 40. this support 40 may be assembled to the substrate made of ferromagnetic material into which bases 24 are micro-machined. Thus, bases 24 are disposed regularly and precisely on substrate 40. Then, a plate formed of the assembly of plates 28 and connecting arms 42 is added. As previously described, openings 6 are provided in the middle of plates 28 so that they can be inserted into the set of arms 26 of the antenna cores. Finally, a plurality of second bases 30 is added to form the batch of antennae. These bases 30 are also disposed on an adhesive support which is not shown and is similar to support 40. Once bases 24 and 30 are assembled for example by bonding, at least one of the adhesive supports is removed and a step of cutting arms 42 is provided to form antennae distinct from each other. Finally, when an adhesive support is kept for said cutting step, the batch of antennae may remain assembled to the remaining adhesive substrate until they are mounted in respective devices in which they are intended to be integrated.

It will be noted finally that the electric contact pads of the windings may advantageously be disposed, as in the embodiment previously described, on tongues connected to plate 28 to facilitate the connection of winding 12 to the electronic device in which antenna 22 is integrated. In an advantageous embodiment, these tongues are folded and secured against the back of the first or second base 24 or 30 so that the electric contact pad or pads located on each tongue is turned outwards. This allows easy mounting of antennae 22 in accordance with a surface mounting technique (SMD).

The inductive components arranged for surface mounting find application in particular in the field of telecommunications, to help the hard of hearing, and for other portable devices.

What is claimed is:

1. Electronic component of the inductive type, in particular an inductance coil, transformer or antenna, including:

a first part (1) made of magnetic material forming a first base (9) and at least an arm **(8*b*)** projecting above said first base;

a second part (13) made of magnetic material forming at least a second base and being secured to the free end of said arm of said first part so as to define therewith a core or a magnetic circuit, a plate (4) inserted between said first and second bases and having an opening for the passage of said arm, this plate (4) carrying at least one electrically conductive winding (12) which surrounds said arm **(8*b*), this winding ending by at least two electric contact plates (7*a*, 7*b*) located outside the projection of said first and second bases in the general plane of said plate, characterised in that said at least two electric contact pads are located on at least one tongue (16, 18)** formed of at least one layer or sheet of said plate, the end of said at least one tongue being folded and secured onto an external surface of said first or second base such that said electric contact pads are turned outwards.

2. The electric component according to claim 1, characterised in that said first and second parts (1, 13) made of magnetic material together form a closed magnetic circuit with three arms **(8*a*, 8*b*, 8*c*) connecting said first and second bases, said winding surrounding the central arm (8*b*)**.

3. The electric component according to claim 2, characterised in that the plate (4) includes two tongues (16, 18) each having at least one electric contact pad, these tongues being folded and secured onto the same external surface of said magnetic circuit.

* * * * *